US009429904B2

(12) United States Patent
Yasumoto et al.

(10) Patent No.: US 9,429,904 B2
(45) Date of Patent: Aug. 30, 2016

(54) IMAGE CARRIER UNIT AND IMAGE FORMING APPARATUS

(71) Applicant: CANON KABUSHIKI KAISHA, Tokyo (JP)

(72) Inventors: Takeshi Yasumoto, Abiko (JP); Dai Kanai, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/472,575

(22) Filed: Aug. 29, 2014

(65) Prior Publication Data

US 2015/0063867 A1 Mar. 5, 2015

(30) Foreign Application Priority Data

Sep. 3, 2013 (JP) ..... 2013-182006

(51) Int. Cl.
*G03G 21/18* (2006.01)

(52) U.S. Cl.
CPC ..... *G03G 21/1828* (2013.01); *G03G 21/1814* (2013.01); *G03G 21/1832* (2013.01)

(58) Field of Classification Search
CPC ..... G03G 21/1814; G03G 21/1828
See application file for complete search history.

(56) References Cited

U.S. PATENT DOCUMENTS

| | | | | |
|---|---|---|---|---|
| 4,470,689 | A * | 9/1984 | Nomura et al. | 399/114 |
| 4,766,455 | A * | 8/1988 | Carter | 399/116 |
| 6,002,896 | A * | 12/1999 | Miyamoto et al. | 399/114 |
| 6,829,455 | B2 | 12/2004 | Yasumoto et al. | |
| 7,039,340 | B1 * | 5/2006 | Goebel | 399/114 |
| 7,092,658 | B2 | 8/2006 | Yasumoto et al. | |
| 7,532,841 | B2 * | 5/2009 | Tanaka | 399/114 |
| 7,929,881 | B2 * | 4/2011 | Yoshino et al. | 399/113 |
| 8,055,154 | B2 * | 11/2011 | Iikura et al. | 399/111 |
| 8,095,036 | B2 * | 1/2012 | Yoshino et al. | 399/114 |
| 2004/0126134 | A1 * | 7/2004 | Harada et al. | 399/114 |
| 2004/0190936 | A1 * | 9/2004 | Yoshiyuki et al. | 399/114 |
| 2005/0123319 | A1 * | 6/2005 | Mizoguchi | 399/111 |
| 2007/0206971 | A1 * | 9/2007 | Yoshino | 399/111 |
| 2008/0232847 | A1 * | 9/2008 | Kusukawa et al. | 399/114 |
| 2010/0209137 | A1 * | 8/2010 | Takiguchi et al. | 399/111 |
| 2012/0134711 | A1 * | 5/2012 | Kusukawa | 399/114 |
| 2012/0177414 | A1 * | 7/2012 | Ikeguchi et al. | 399/262 |

FOREIGN PATENT DOCUMENTS

| | | |
|---|---|---|
| JP | 2004-170556 | 6/2004 |
| JP | 2009-075274 | 9/2009 |

* cited by examiner

*Primary Examiner* — David Bolduc
(74) *Attorney, Agent, or Firm* — Fitzpatrick, Cella, Harper & Scinto

(57) ABSTRACT

An image carrier unit includes an engage mechanism configured to attach a protection cover slidably to a unit casing in a rotational axis direction of an image carrier. The engage mechanism includes first and second engage mechanisms. The first engage mechanism includes a first engage portion provided at a first end portion in a width direction orthogonal to the rotational axis direction of the protection cover and a first engaged portion provided in the unit casing and engaged with the first engage portion, and is configured such that the first engage portion engages with the first engaged portion in orientation to one side in the width direction. The second engage mechanism is also configured such that a second engage portion engages with a second engaged portion in orientation to the one side in the width direction.

15 Claims, 12 Drawing Sheets

IMAGE CARRIER UNIT AND IMAGE FORMING APPARATUS

BACKGROUND OF THE INVENTION

1. Field of the Invention

The present invention relates to an image carrier unit including an image carrier capable of carrying an electrostatic image and image forming apparatus including the image carrier unit.

2. Description of the Related Art

There is widely used such an image forming apparatus configured to transfer a toner image formed on an image carrier to a sheet directly or through an intermediary of an intermediate transfer body and to fix the image to the sheet by heating and pressing the sheet to which the toner image has been transferred. In general, a photoconductive drum which is one exemplary image carrier is supplied to a user in a form of a process cartridge which is one exemplary image carrier unit. The process cartridge is configured such that a charging device, a developing device and others are built into a cartridge casing together with the photoconductive drum and to be able to replace them in a body.

Japanese Patent Application Laid-open Nos. 2004-170556 and 2009-75274 disclose an image forming apparatus in which a plurality of process cartridges is arrayed along an intermediate transfer belt. The plurality of process cartridges is configured to be able to be attached and to be replaced individually to/from a casing of the image forming apparatus by being moved in a rotational axis direction of the photoconductive drum.

The process cartridge disclosed in Japanese Patent Application Laid-open No. 2004-170556 is provided with an opening for making the photoconductive drum come into contact with the intermediate transfer belt and with a protection cover of the photoconductive drum for covering the opening. The protection cover prevents the photoconductive drum from being irradiated by light or from collecting dusts during processes of shipping and storage of the process cartridge. The protection cover engages with first and second engage portions disposed at both sides of the opening of a cartridge casing and is held to be able to move in the rotational axis direction of the photoconductive drum.

As shown in FIG. 10A, a direction in which the engagement at a first engagement mechanism (71L, 72L) becomes shallow is opposite from a direction in which the engagement at a second engagement mechanism (71R and 72R) becomes shallow. Due to that, if the protection cover (10) is strongly pulled in a direction distant from the photoconductive drum 1Bk (upward) as shown in FIG. 10B, the protection cover deforms inwardly, the engagements of the first and second engagement mechanisms become shallow in the same time, and there is a possibility that the protection cover comes off from the process cartridge.

A drum cartridge disclosed in Japanese Patent Application Laid-open No. 2009-75274 is configured such that a protection cover abuts against a casing of an image forming apparatus and is automatically removed such that it is pushed out of a drum cartridge in attaching the drum cartridge to the casing of the image forming apparatus by moving the drum cartridge in a rotation axis direction of the photoconductive drum.

Because such a protection cover is so large as to cover an entire process cartridge, it is not preferable to use an excessive material as a protection cover attached only during a period from a packing state until when the process cartridge is attached to the image forming apparatus. If the whole process cartridge including the protection cover is large, it is troublesome during shipping, storage and handling.

SUMMARY OF THE INVENTION

An image carrier unit includes an image carrier capable of carrying an electrostatic image, a unit casing rotatably storing the image carrier with an opening for exposing a part of the image carrier, a protection cover covering the opening, and an engage mechanism configured to attach the protection cover slidably in a rotational axis direction of the image carrier to the unit casing. The engage mechanism includes a first engage mechanism including a first engage portion provided at a first end portion in a width direction orthogonal to the rotational axis direction of the protection cover and a first engaged portion provided in the unit casing and engaged with the first engage portion, and configured such that the first engage portion engages with the first engaged portion in orientation to one side in the width direction, and a second engage mechanism including a second engage portion provided at a second end portion in the width direction of the protection cover and a second engaged portion which is provided in the unit casing on a side opposite from the first engaged portion across the opening in the width direction, and configured such that the second engage portion engages with the second engaged portion in orientation to the one side in the width direction.

DESCRIPTION OF THE EMBODIMENTS

Embodiments of the present invention will be described in detail below with reference to the drawings.

First Embodiment

Image Forming Apparatus

Figure 1:
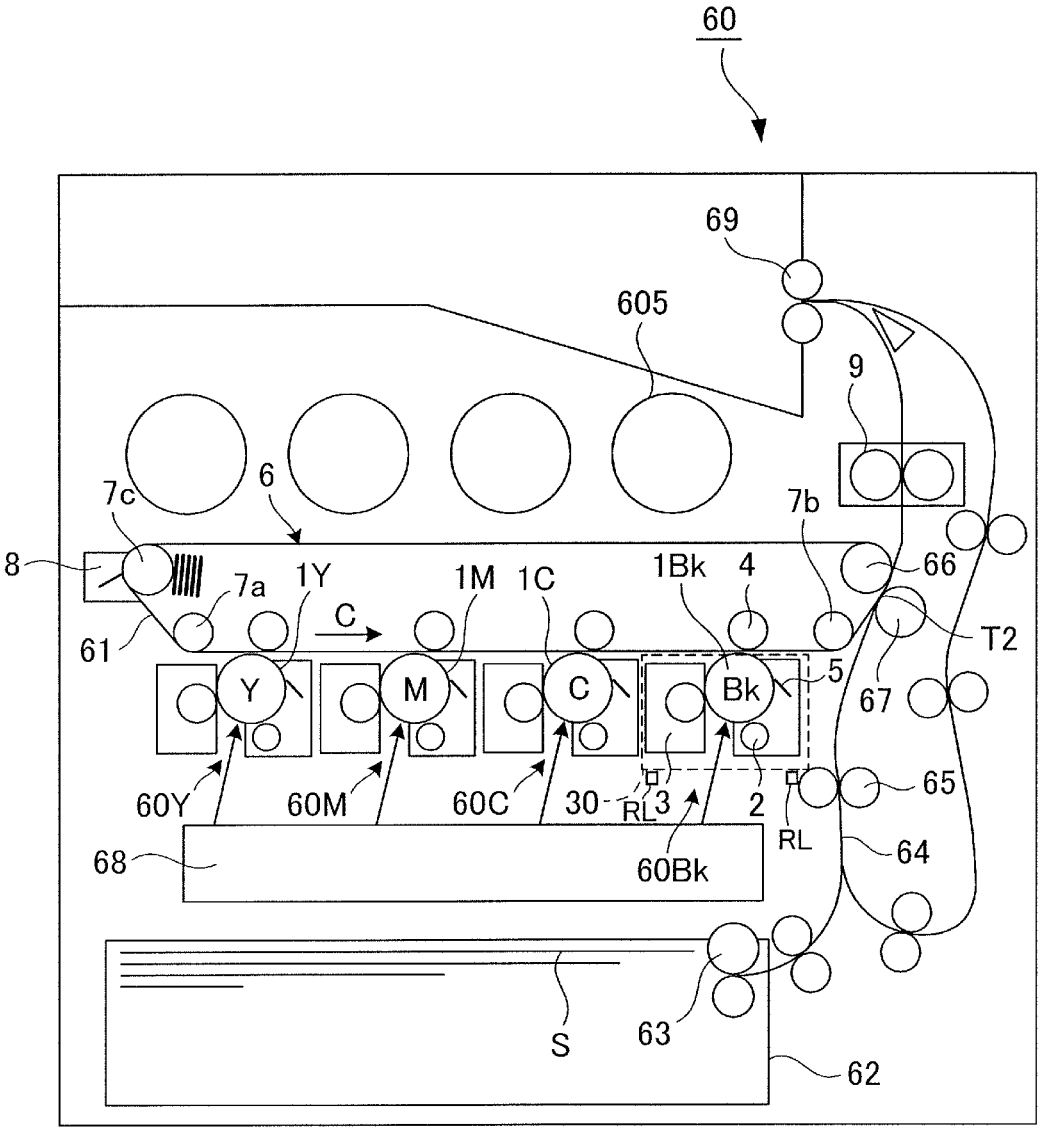
FIG. 1 is a section view schematically showing a configuration of an image forming apparatus of a first embodiment.

FIG. 1 is a section view schematically showing a configuration of an image forming apparatus 60 of the present embodiment. As shown in FIG. 1, the image forming apparatus 60 is a tandem type intermediate transfer full-color printer in which image forming portions 60Y, 60M, 60C and 60Bk are arrayed along an under surface of an intermediate transfer belt 61.

In an image forming portion 60Y, a yellow toner image is formed on a photoconductive drum 1Y and is transferred to an intermediate transfer belt 61. In an image forming portion 60M, a magenta toner image is formed on a photoconductive drum 1M and is transferred to the intermediate transfer belt 61. Cyan and black toner images are formed respectively on the photoconductive drums 1C and 1 Bk in the image forming portions 60C and 60Bk and are transferred to the intermediate transfer belt 61. It is noted that these photoconductive drums 1Y, 1M, 1C and 1Bk are exemplary image carriers. It is also noted that while only the photoconductive drum 1Bk among these photoconductive drums 1Y, 1M, 1C and 1Bk will be typically explained in the following explanation, configurations of the other photoconductive drums 1Y, 1M, and 1C are the same with that of the photoconductive drum 1Bk.

The four color toner images transferred to the intermediate transfer belt 61 are conveyed to a secondary transfer portion T2 and are secondarily transferred to a sheet S. A separation roller 63 separates the sheet S pulled out of a sheet cassette 62 one by one and sends to a registration roller 65. The registration roller 65 feeds the sheet S to the secondary transfer portion T2 by synchronizing with the toner image on the intermediate transfer belt 61. The sheet S on which the four color toner images are secondarily transferred is heated and pressed by a fixing device 9 to fix the toner images on a surface of the sheet S.

As shown in FIG. 1, the intermediate transfer belt 61 which is one exemplary intermediate transfer body is disposed, as a transfer medium, in contact with the photoconductive drum 1Bk of a process cartridge 30 which is one exemplary image carrier unit. A rail RL is additionally provided in the image forming apparatus 60 and guides the process cartridge 30 in the rotational axis direction of the photoconductive drum 1Bk.

(Image Forming Portion)

FIG. 2 illustrates a configuration of the process cartridge. As shown in FIG. 1, the image forming portions 60Y, 60M, 60C and 60Bk are constructed almost in the same manner except that the colors of the toner used in their developing devices are different as yellow, magenta, cyan and black. Then, the image forming portion 60Bk will explained in the following explanation, and an overlapped explanation of the other image forming portions 60Y, 60M and 60C will be omitted here.

As shown in FIG. 1, in the image forming portion 60Bk a charging device 2, an exposure device 68, a developing device 3, a transfer roller 4, and a drum cleaning device 5 are disposed around the photoconductive drum 1Bk. The photoconductive drum 1Bk includes a photoconductive layer formed on an outer circumferential surface of an aluminum cylinder, and rotates at a predetermined processing speed.

The charging device 2 applies a vibration voltage, in which an AC voltage is superimposed on a negative DC voltage, to a charging roller to charge the photoconductive drum 1Bk with homogeneous negative potential. The exposure device 68 scans a laser beam obtained by ON-OFF modulating a scan line image signal in which each color image is developed by a rotation mirror to draw an electrostatic image of an image on the surface of the photoconductive drum 1Bk.

Figure 2A:
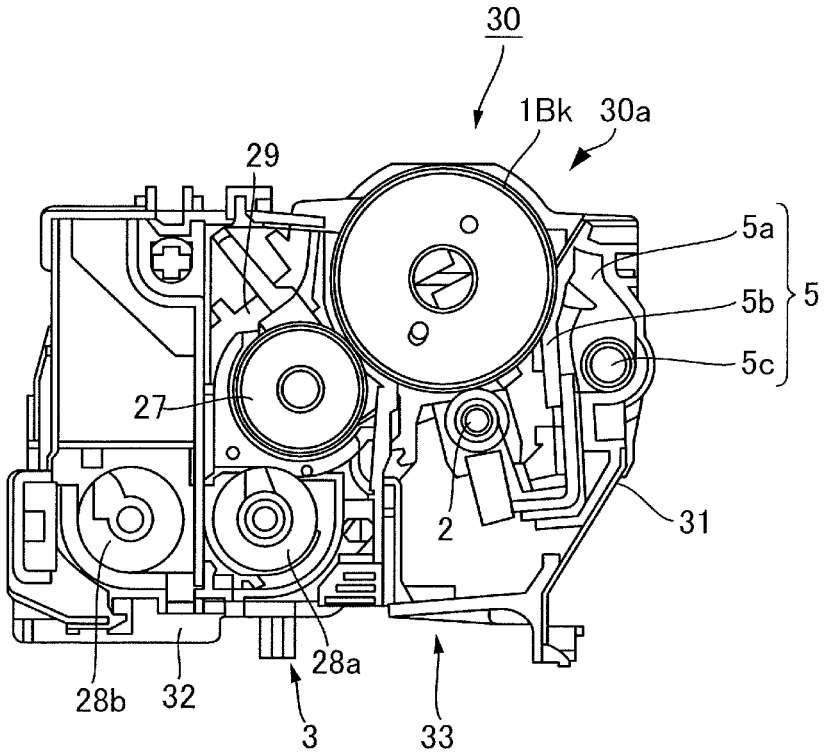
FIG. 2A is a section view showing an overall configuration of a process cartridge of the first embodiment.

Developer containing toner and carrier is filled in a developer container 32 shown in FIG. 2A. Agitating and conveying screws 28*a* and 28*b* agitate/circulate the developer within a developer container 32 to charge the toner to minus and the carrier to plus. A development sleeve 27 carries the developer by magnetic force of magnets disposed within the development sleeve 27. A layer thickness restricting portion 29 restricts a layer thickness of the developer carried by the development sleeve 27. The development sleeve 27 carries the charged developer in a napped state and frictionally slides around the photoconductive drum 1Bk. When the vibration voltage, in which an AC voltage is superimposed on a DC voltage, is applied to the development sleeve 27, the toner of the development sleeve 27 is transferred to the electrostatic image on the photoconductive drum 1Bk and the electrostatic image on the photoconductive drum 1Bk is developed as a toner image.

As shown in FIG. 1, new toner corresponding to an amount of toner consumed in the developing device 3 to form the image is replenished from a toner cartridge 605 to the developing device 3 through a toner conveying path not shown.

The transfer roller 4 is built in an intermediate transfer unit 6 including the intermediate transfer belt 61. The transfer roller 4 presses the intermediate transfer belt 61 and forms a transfer portion between the photoconductive drum 1Bk and the intermediate transfer belt 61. The negative toner image carried on the photoconductive drum 1Bk is transferred to the intermediate transfer belt 61 by applying a positive DC voltage to the transfer roller 4.

The intermediate transfer belt 61 is suspended around and supported by a tension roller 7*c*, a drive roller 66 which functions also as a secondary transfer roller, and tension rollers 7*a* and 7*b*, and rotates in a direction of an arrow C by being driven by the drive roller 66. A secondary transfer roller 67 is in contact with the intermediate transfer belt 61 whose inner surface is supported by the drive roller 66 and forms the secondary transfer portion T2. The toner image on the intermediate transfer belt 61 is transferred to the sheet S by a positive DC voltage applied to the secondary transfer roller 67.

The drum cleaning device 5 is configured such that a cleaning blade 5*b* rubs the photoconductive drum 1Bk to remove transfer residual toner attached on the surface of the photoconductive drum 1Bk. A belt cleaning device 8 is configured such that a cleaning blade rubs the intermediate transfer belt 61 to recover transfer residual toner on the surface of the intermediate transfer belt 61.

(Process Cartridge)

As shown in FIG. 1, the process cartridge 30 is what the photoconductive drum 1Bk of the image forming portion 60Bk, the developing device 3 and others are integrally unitized to be able to attach to/detach from the image forming apparatus 60. The process cartridge 30 can be attached to a body frame (casing of the image forming apparatus) HF of the image forming apparatus 60 in a state in which a protection cover 10 described later is removed by moving the process cartridge 30 in the rotational axis direction of the photoconductive drum 1Bk.

As shown in FIG. 2A, the process cartridge 30 is constructed by connecting a drum unit 33 with the developing device 3. The drum unit 33 includes a photoconductive drum container (unit casing) 31, the photoconductive drum 1Bk, the charging device 2, the cleaning blade 5*b*, and a toner discharge screw 5*c*. The toner discharge screw 5*c* conveys the transfer residual toner scraped by the cleaning blade 5*b* to a cleaner recovery space 5*a* to convey a recovery toner container not shown.

The exposure device 68 shown in FIG. 1 performs scanning exposure of the laser beam to the surface of the photoconductive drum 1Bk through an opening located at an under surface of the process cartridge 30. A large opening 30*a* for making the photoconductive drum 1Bk come into contact with the intermediate transfer belt 61 shown in FIG. 1 is made through an upper surface of the process cartridge 30, and the photoconductive drum 1Bk is exposed upward.

Figure 3A:
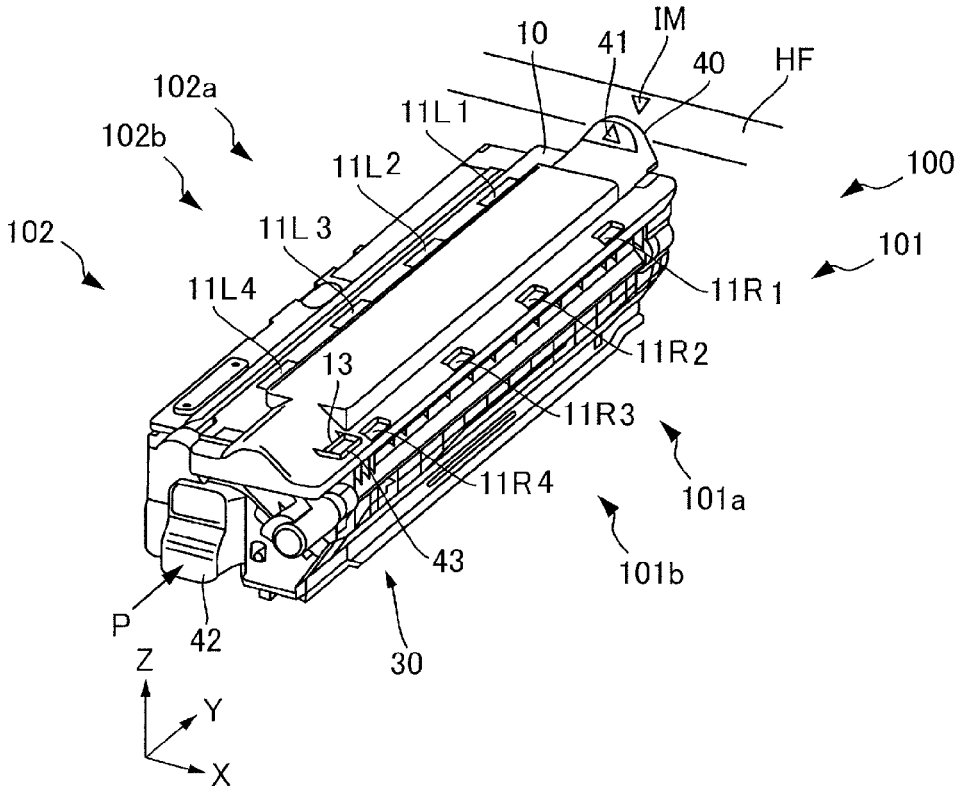
FIG. 3A is perspective view of the process cartridge before attaching to the image forming apparatus.
Figure 3B:
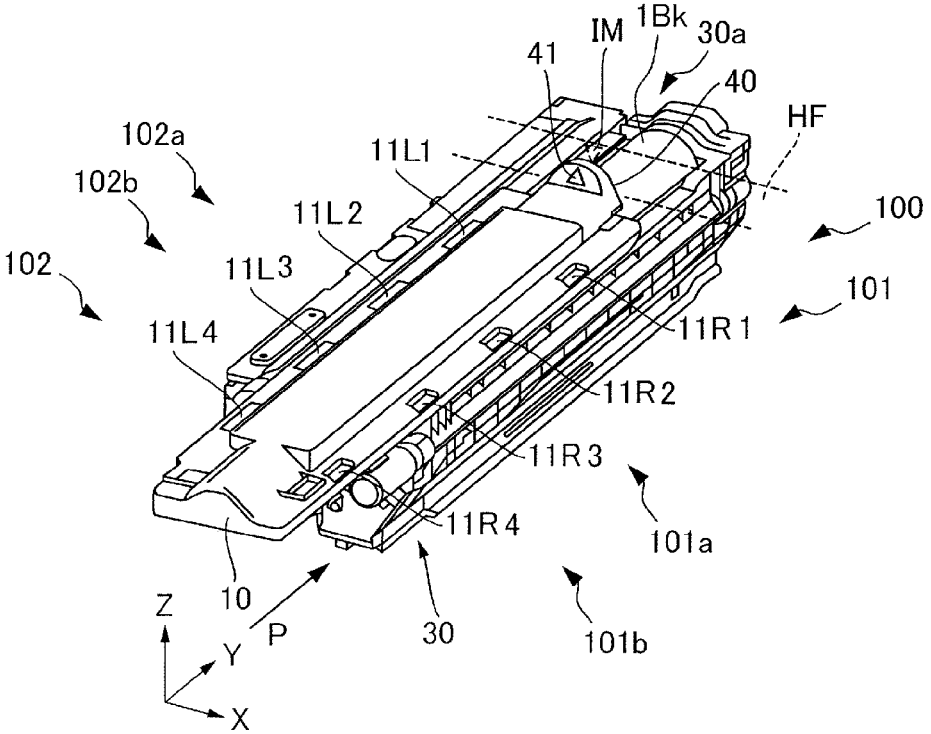
FIG. 3B is a perspective view of the process cartridge being attached to the image forming apparatus.

As shown also in FIGS. 3A and 3B, the process cartridge 30 includes the photoconductive drum 1Bk capable of carrying the electrostatic image, the photoconductive drum container 31 rotatably storing the photoconductive drum 1Bk with the opening 30*a* for exposing a part of the photoconductive drum 1Bk, the protection cover 10 covering the opening 30*a*, and an engage mechanism 100 slidably attaching the protection cover 10 to the photoconductive drum container 31 in the rotational axis direction of the photoconductive drum 1Bk.

(Protection Cover)

Figure 6A:
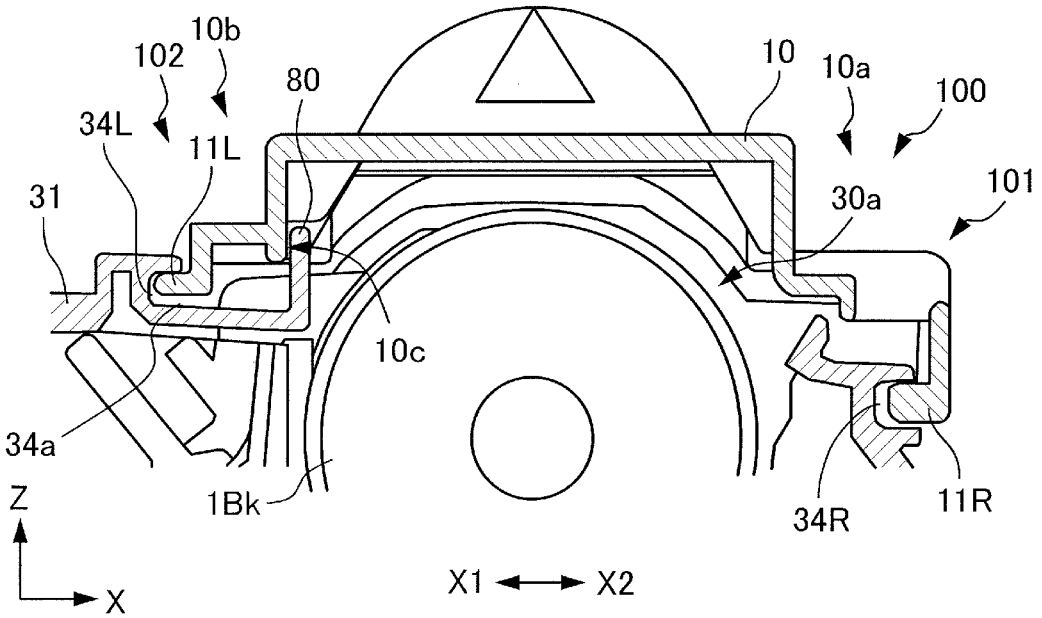
FIG. 6A illustrates a state in which the protection cover is attached to the process cartridge.
Figure 6B:
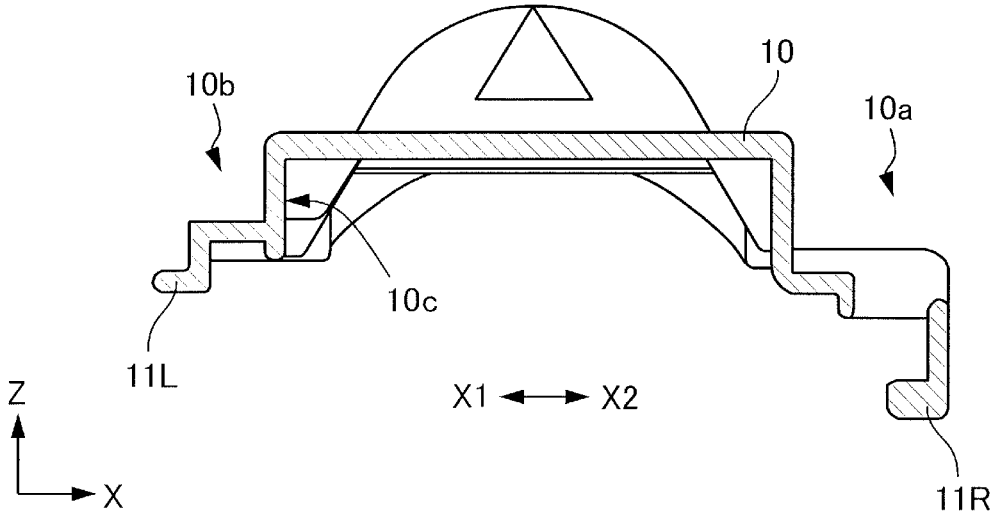
FIG. 6B is a section view schematically showing a configuration of the protection cover.

FIG. 3A is a perspective view of the process cartridge 30 before attaching to the image forming apparatus 60 of the present embodiment. FIG. 3B is a perspective view of the process cartridge 30 during when it is attached to the image forming apparatus 60 of the present embodiment. FIG. 6A illustrates a state in which the protection cover 10 is attached to the process cartridge 30. FIG. 6B is a section view schematically showing a configuration of the protection cover 10. Here, in the present embodiment, the rotational axis direction of the photoconductive drum 1Bk will be defined as a Y-axis direction, a width direction orthogonal to the rotational axis direction of the photoconductive drum 1Bk, i.e., a moving direction of the intermediate transfer belt 61 in contact with the photoconductive drum 1Bk, is defined as an X-axis direction, and a vertical direction orthogonal to these X and Y-axes directions will be defined as a Z-axis direction.

Figure 4A:
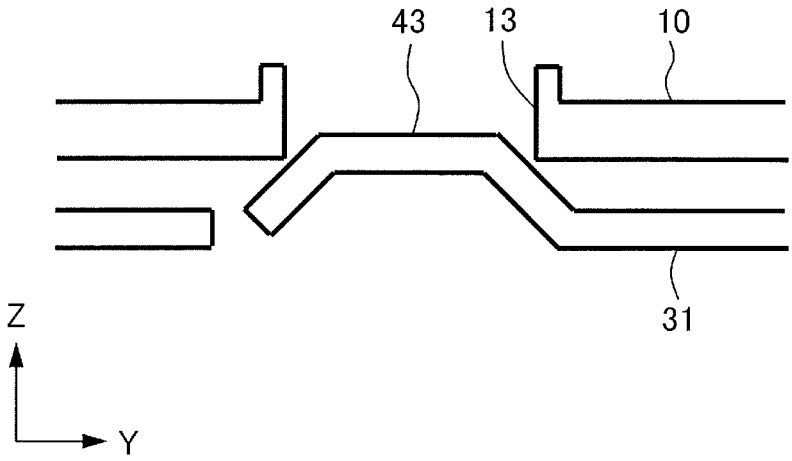
FIG. 4A illustrates a state in which the protection cover is attached to a unit casing of the process cartridge of the first embodiment.
Figure 4B:
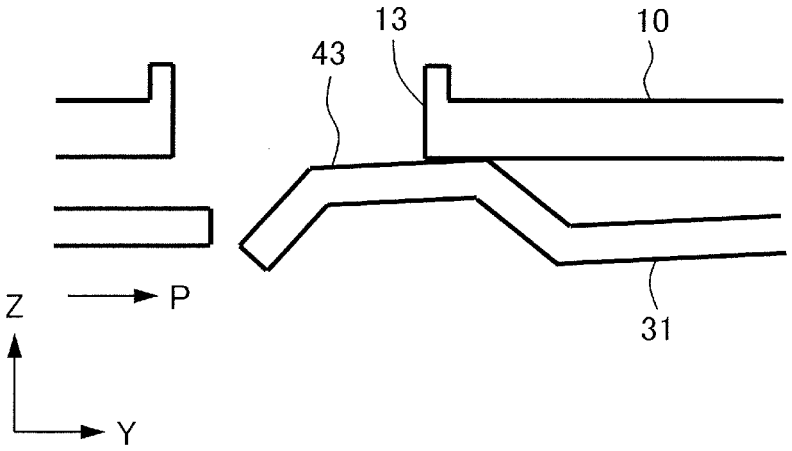
FIG. 4B illustrates a state in which the protection cover is removed out of the unit casing of the process cartridge of the first embodiment.

As shown in FIG. 3A, the process cartridge 30 is attached with the protection cover 10 and the photoconductive drum 1Bk is covered by the protection cover 10 (see FIG. 3B) right after when the process cartridge 30 is unpacked. As shown in FIGS. 3A and 4A, the protection cover 10 is fixed to the photoconductive drum container 31 by locking a hook 43 made of resin spring and provided to the photoconductive drum container 31 of the process cartridge 30 by an engagement hole 13 in a manner of snap-fit. Due to that, even if the process cartridge 30 is slanted in various directions including a longitudinal direction, the protection cover 10 will not readily come off. It is noted that as shown in FIGS. 3B and 4B, the hook 43 is configured such that it deflects and the protection cover 10 is unlocked from the opening 13 when a manipulation force in a direction of an arrow P increases more than a predetermined degree.

As shown in FIG. 3A, a positioning mark 41 is marked at a positioning portion (abutment portion) 40 of the protection cover 10. The positioning portion 40 is provided at an inner side end in the Y-axis direction of the protection cover 10 and is formed into a shape of a flange projecting upward. The positioning portion 40 is also formed such that its profile is circular arc when seen from the Y-axis direction. A user (or a service technician) sets the process cartridge 30 into the image forming apparatus 60 by positioning the positioning mark 41 of the protection cover 10 at a positioning mark IM marked on the body frame HF of the image forming apparatus 60 (see FIG. 1). The hook 43 comes off from the opening 13 and the process cartridge 30 is inserted into the image forming apparatus 60 while leaving the protection cover 10 by pushing a grip 42 in a direction of an arrow P in the state in which the positioning mark 41 is positioned at the mark IM.

That is, the protection cover 10 includes the positioning portion 40 that abuts against the body frame HF and moves the protection cover 10 in the Y-axis direction with respect to the photoconductive drum container 31 when the photoconductive drum container 31 is moved in the Y-axis direction to attach to the body frame HF.

As shown in FIG. 3B, the process cartridge 30 moves inside by being guided by the rail RL (see FIG. 1) of the image forming apparatus 60. The process cartridge 30 is moved in the direction of the arrow P while attaching the protection cover 10 to attach to the image forming apparatus 60. During such process, the positioning portion 40 abuts against the body frame HF of the image forming apparatus 60 and the protection cover 10 is left at a front side.

Figure 5A:
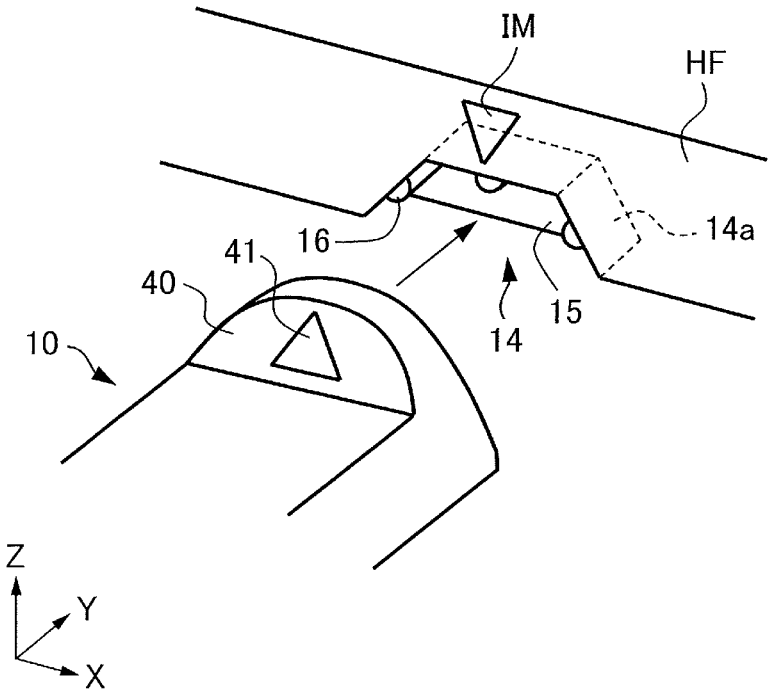
FIG. 5A illustrates a state in which the protection cover approaches to a body frame in attaching the process cartridge of the first embodiment to the image forming apparatus.
Figure 5B:
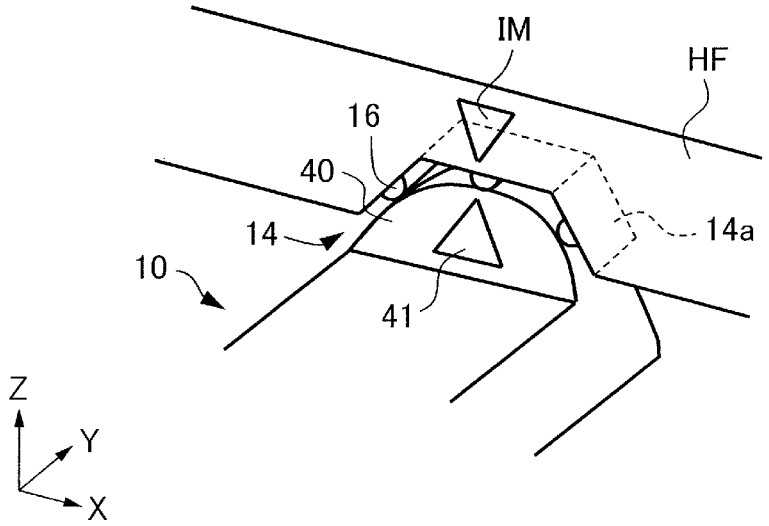
FIG. 5B illustrates a state in which an abutting portion of the protection cover abuts against an abutment portion of the body frame and is held by a holding portion in attaching the process cartridge of the first embodiment to the image forming apparatus.

Here, as shown in FIG. 5A, the body frame HF includes an abutted portion 15 against which the positioning portion 40 of the protection cover 10 abuts in attaching the process cartridge 30 to the body frame HF by moving in the Y-axis direction and a holding portion 14 configured to hold the protection cover 10 that has been attached to the process cartridge 30. The holding portion 14 is formed of a fitting portion configured to hold the protection cover 10 by fitting the positioning portion 40 of the protection cover 10. In the present embodiment, the holding portion 14 is a rectangular concave portion formed in the body frame HF and is provided with a plurality of holding projections 16 projecting in orientation to inside at part of an inner surface 14*a*. The abutment portion 15 is provided inside in the Y-axis direction of the holding portion 14.

Therefore, when the photoconductive drum container 31 is attached to the body frame HF by moving the photoconductive drum container 31, to which the protection cover 10 is attached, in the Y-axis direction, the protection cover 10 is removed from the photoconductive drum container 31 by being moved in the Y-axis direction with respect to the photoconductive drum container 31 by abutting the positioning portion 40 of the protection cover 10 against the abutment portion 15 of the body frame HF. At this time, a peripheral side surface of the positioning portion 40 is fitted into the holding projections 16 and the protection cover 10 is held by the body frame HF. Thereby, the protection cover 10 is held by the body frame HF, and it is possible to prevent the protection cover 10 from dropping right after when the photoconductive drum container 31 is attached and when the protection cover 10 is removed out of the photoconductive drum container 31 when the photoconductive drum container 31 is completely attached to the body frame HF. Accordingly, this arrangement makes it possible to improve workability of a replacement work of the process cartridge 30 by preventing the unintentional drop of the protection cover 10.

The process cartridge 30 is lifted by a slope by a final 10 mm in the insertion process to make the photoconductive drum 1Bk come into contact with the intermediate transfer belt 61. When the process cartridge 30 is completely inserted, the protection cover 10 is held by the holding portion 14 of the body frame HF while keeping an initial position. The user takes the protection cover 10 out of the body frame HF by pulling in orientation to the front side.

As shown in FIG. 3A, the engage mechanism 100 includes first and second engage mechanisms 101 and 102.

The first engage mechanism 101 includes a first engage portion 101*a* provided at a first end portion 10*a* in the X-axis direction of the protection cover 10 and a first engaged portion 101*b* provided in the photoconductive drum container 31 and engaged with the first engage portion 101*a* and is configured such that the first engage portion 101*a* engages with the first engaged portion 101*b* in orientation to one side X1 in the X-axis direction. That is, the first engage mechanism 101 is configured such that the first engage portion 101*a* formed convexly in orientation to one side X1 in the X-axis direction engages with the first engaged portion 101*b* formed concavely opened in orientation to another side X2 in the X-axis direction. Here, the engagement of the first engage portion 101*a* with the first engaged portion 101*b* means that the first engage portion 101*a* of the convex shape fits into the first engaged portion 101*b* of the concave shape in one side X1 in the X-axis direction.

Still further, the first engage portion 101*a* includes a plurality of first convex portions (first engage members) 11R1 through 11R4 disposed at a plurality of places with certain intervals along the Y-axis direction. The first engaged portion 101*b* also includes a first concave portion 34R along the Y-axis direction. It is noted that because all of the first convex portions 11R1 through 11R4 are constructed and act in the same manner, one convex portion will be explained typically by denoting as 11R in the following explanation.

The second engage mechanism 102 includes a second engage portion 102*a* provided at a second end portion 10*b* of the protection cover 10 and a second engaged portion 102*b* formed into a shape of a groove for example and provided in the photoconductive drum container 31 on a side opposite from the first engaged portion 101*b* across the opening 30*a* in the X-axis direction, and is configured such that the second engage portion 102*a* engages with the second engaged portion 102*b* in orientation to one side X1 in the X-axis direction. That is, the second engage mechanism 102 is configured such that the second engage portion 101*a* formed into a convex shape in orientation to one side X1 in the X-axis direction engages with the second engaged portion 101*b* formed into a concave shape opening in orientation to the other side X2 in the X-axis direction. Here, the engagement of the second engage portion 102*a* with the second engaged portion 102*b* means that the second engage portion 102*a* of the convex shape fits into the second engaged portion 102*b* of the concave shape in orientation to one side X1 in the X-axis direction.

The second engage portion 102*a* also includes a plurality of second convex portions (second engage members) 11L1 through 11L4 disposed at a plurality of places at certain intervals along the Y-axis direction. The second engaged portion 102*b* also includes a second concave portion 34L along the Y-axis direction. It is noted that because all of the second convex portions 11L1 through 11L4 are constructed and act in the same manner, one convex portion will be explained typically by denoting as 11L in the following explanation.

As shown in FIG. 6A, the protection cover 10 can be moved in the rotational axis direction of the photoconductive drum 1Bk in a state in which the first projection 11R is engaged with the first concave portion 34R and the second projection 11L is engaged with the second concave portion 34L.

The protection cover 10 is provided with the plurality of first engage members 11R1 through 11R4 and the plurality of second engage members 11L1 through 11L4 arrayed in the longitudinal direction (in the Y-axis direction, rotational axis direction) at both ends in the X-axis direction thereof. Because the first engage members 11R1 through 11R4 and the second engage members 11L through 11L4 engage at a plurality of positions in the longitudinal direction, the protection cover 10 functions also as a rail guiding the insertion in the Y-axis direction of the process cartridge 30 while restricting the position of the process cartridge 30 in the Z-axis direction in attaching to the image forming apparatus 60.

By the way, the protection cover 10 is a part attached to the process cartridge 30 only during a period until when the process cartridge 30 is attached to the image forming apparatus 60 undergoing a storage condition after when the process cartridge 30 is manufactured and is packed. In order to let the user understand that the process cartridge 30 is a component used by removing the protection cover 10, the protection cover 10 is colored by conspicuous color such as orange fluorescent color which is obviously different from surrounding parts within the image forming apparatus 60.

Therefore, there is a possibility that a user who handles the process cartridge 30 for the first time erroneously removes the protection cover 10 immediately from the process cartridge 30 in taking out the process cartridge 30 by unpacking the process cartridge 30. There is also another possibility that the user removes the protection cover 10 from the process cartridge 30 in a stage before inserting the process cartridge 30 to the image forming apparatus 60.

However, the protection cover 10 is a part that functions also as a guide in inserting the process cartridge 30 to the image forming apparatus 60 and is automatically removed from the process cartridge 30. Therefore, if the protection cover 10 is removed before inserting the process cartridge 30 to the image forming apparatus 60, the chance of using the protection cover 10 as the insertion guide in setting the process cartridge 30 in the image forming apparatus 60 is lost and the original role of the protection cover 10 cannot be achieved. If the process cartridge 30 is inserted into the image forming apparatus 60 in a state in which the protection cover 10 is removed, there is a possibility that the photoconductive drum 1Bk collides against peripheral devices and structures and the photoconductive drum 1Bk is damaged in the processes of positioning and inserting the process cartridge 30 into the image forming apparatus 60.

Still further, if the protection cover 10 is tried to be forcibly removed from the process cartridge 30, there is a possibility that the photoconductive drum 1Bk is damaged by colliding against the protection cover 10 and tools by momentum in removing the protection cover 10.

(Engagement Structure of Present Embodiment)

Figure 7A:
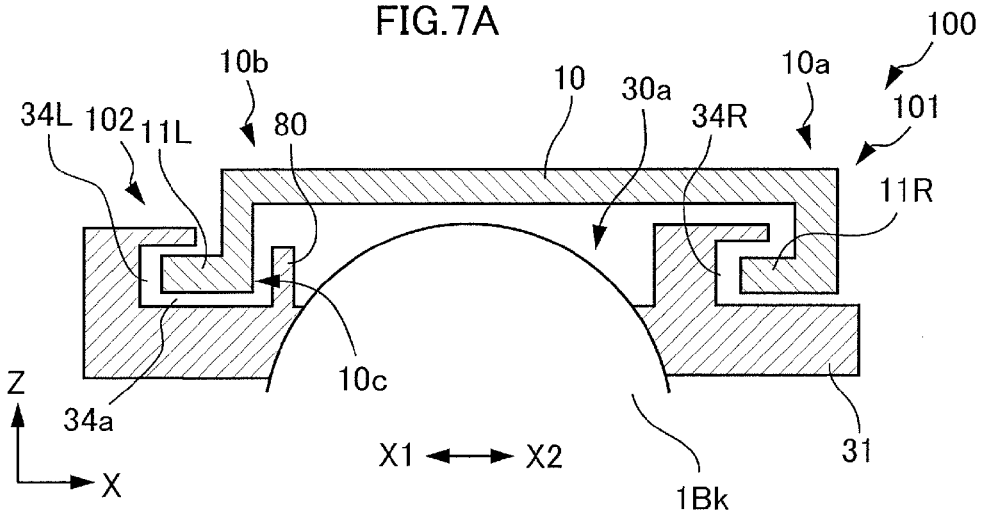
FIG. 7A illustrates a state in which no external force acts on the protection cover attached to the process cartridge.
Figure 7B:
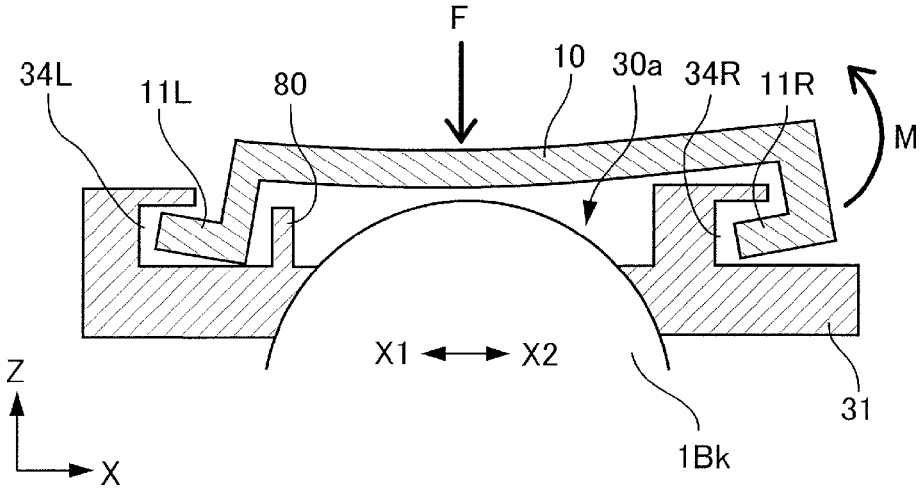
FIG. 7B illustrates a state in which an external force acts vertically in orientation to an opening to the protection cover attached to the process cartridge.
Figure 7C:
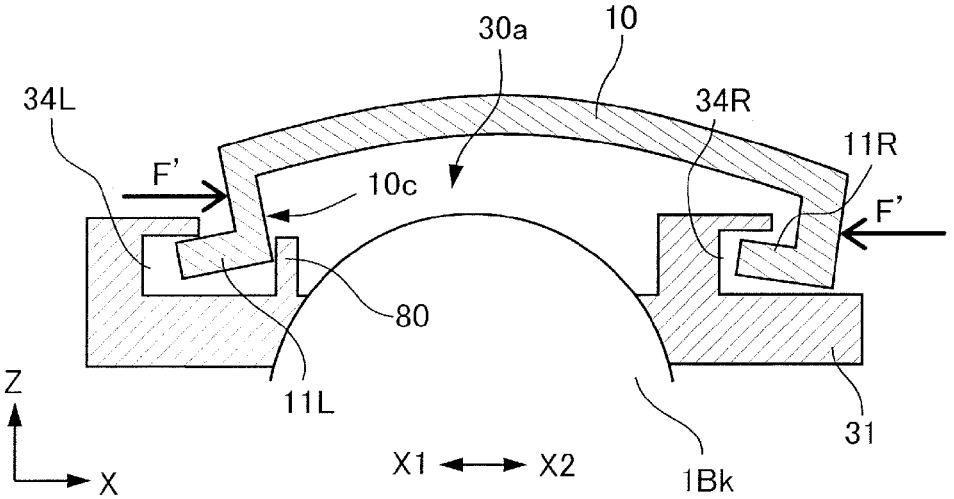
FIG. 7C illustrates a state in which an external force acts by grasping the protection cover attached to the process cartridge.

FIGS. 7A, 7B, and 7C illustrate engagement states of the protection cover 10 with the process cartridge 30. FIG. 7A illustrates a state in which the protection cover 10 is attached. FIG. 7B illustrates a state in which the protection cover 10 is pressed downward, and FIG. 7C illustrates a state in which the protection cover 10 is grasped from the X-axis direction.

Figure 2B:
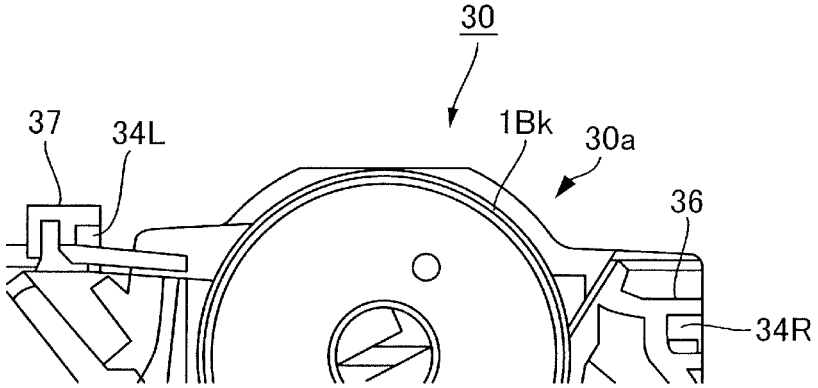
FIG. 2B is an enlarged section view of a part of the configuration of the process cartridge.

As shown in FIG. 2B, depth directions of the grooves of the first and second concave portions 34R and 34L of the process cartridge 30 orient in the same direction.

As shown in FIG. 6B, projecting directions of the claws of the first and second convex portions 11R and 11L of the protection cover 10 are the same. As shown also in FIG. 3B, the projecting directions of the claws of the first and second convex portions 11R and 11L of the protection cover 10 orient both in the direction of X1 in FIG. 3B.

Because the first convex portion 11R is engaged with the first concave portion 34R and the second convex portion 11L is engaged with the second concave portion 34L in the same time, the protection cover 10 is slidable in the Y-axis direction while being restricted so as not to deviate from the process cartridge 30 in the Z-axis direction.

The process cartridge 30 also includes a restricting portion 80 in the present embodiment. The restricting portion 80 is provided either at the photoconductive drum container 31 or the protection cover 10 and is configured to restrict the protection cover 10 attached to the photoconductive drum container 31 from moving in the other side X2 in the X-axis direction of the protection cover 10 by abutting against the photoconductive drum container 31 or the protection cover 10.

As shown in FIG. 7A, the restricting portion 80 is provided on the photoconductive drum container 31 so as to face the opening 34*a* of the second concave portion 34L, which is formed into a concave shape, in the X-axis direction when seen from the Y-axis direction and is configured to restrict the move in the X-axis direction of the second convex portion 11L engaged with the second concave portion 34L between the second concave portion 34L and the restricting portion 80. Still further, the second concave portion 34L is formed such that it opens in orientation to the photoconductive drum 1Bk side in the X-axis direction, and the restricting portion 80 is disposed between the second concave portion 34L and the photoconductive drum 1Bk in the X-axis direction.

As shown in FIG. 6A, the restricting portion 80 provided in the process cartridge 30 abuts against an inner surface 10*c* facing the other side X2 in the X-axis direction of the protection cover 10 at the position close to the second concave portion 34L and restricts the protection cover 10 from being shifted in the X-axis direction and coming off.

As shown in FIG. 7A, the first and second convex portions 11R and 11L provided at the both end portions in the X-axis direction of the protection cover 10 orient in the same direction from each other in the present embodiment. The first and second convex portions 11R and 11L projecting in the same direction in the protection cover 10 engage with the first and second concave portions 34R and 34L concaved in the same direction in the photoconductive drum container 31.

When the protection cover 10 is pressed downward (in the Z-axis direction) by a force F as shown in FIG. 7B, while a degree of the engagement of the first convex portion 11R becomes less, a degree of the engagement of the second convex portion 11L increases, so that the protection cover 10 will not come off from the photoconductive drum container 31. Even when the protection cover 10 is twisted upward with a moment M, while a degree of the engagement of the first convex portion 11R is lessened, a degree of the engagement of the second convex portion 11L increases, so that the protection cover 10 will not come off from the photoconductive drum container 31. Here, 'the engagement becomes shallow or is lessened' means that a degree of the engagement (a degree of entry entering a groove bottom direction) of each of the convex portions 11R and 11L with each of the concave portions 34R and 34L is lessened. 'The engagement is deepened' means that a degree of the engagement (a degree of entry entering the groove bottom direction) of each of the convex portions 11R and 11L with each of the concave portions 34R and 34L increases.

In a case where a force F' is applied to the both ends in the X-axis direction of the protection cover 10 by gripping the protection cover 10 in the X-axis direction as shown in FIG. 7C, the inner surface 10*c* of the protection cover 10 abuts against the restricting portion 80 of the photoconductive drum container 31 and each of the convex portions 11R and 11L cannot move in a direction in which the engagement is lessened. The restricting portion 80 provided on the photoconductive drum container 31 prevents the protection cover 10 from deviating in the X-axis direction.

The case where the moment M acts on the protection cover 10 happens in a case where the user tries to removes the protection cover 10 at first by erroneously considering the protection cover 10 as a packing member. The case where the force F' acts on the protection cover 10 is a case where the user tries to remove the protection cover 10 at first. Such cases are readily assumable, and the narrower the area covered by the protection cover 10 on the process cartridge 30, the higher the possibility of deviation of each of the convex portions 11R and 11L is.

Effects of the Present Embodiment

According to the present embodiment, the engagements of the first and second convex portions 11R and 11L engaging respectively at the both right and left sides seen from the inserting direction (Y-axis direction) of the protection cover 10 and the process cartridge 30 orient in the same direction X1 in the horizontal direction (X-axis direction) and the protection cover 10 is restricted from deviating in the vertical direction (Z-axis direction) by engaging the convex portions 11R and 11L respectively with the concave portions 34R and 34L.

According to the present embodiment, because the first and second convex portions 11R and 11L orient in the same direction, either one of the convex portions 11R and 11L bites in a direction of increasing a degree of engagement when an external force F or a moment M acts on the protection cover 10, the protection cover 10 is not readily removed. Even if the protection cover 10 is a size protecting a minimum necessary size of the opening 30*a*, the protection cover 10 will not be removed unintentionally during the replacement work of the process cartridge 30. Or, even if one tries to remove the protection cover 10 forcibly from the process cartridge 30 by performing an unanticipated operation, the protection cover 10 is hardly removed. The present embodiment makes it possible to realize such engagement structure of the protection cover 10 by the simple structure.

According to the present embodiment, because the protection cover 10 is hardly removed even if the user erroneously tries to remove the protection cover 10, there is less possibility of damaging the photoconductive drum 1Bk by removing the protection cover 10. Because the protection cover 10 can be utilized as the insertion guide of the process cartridge 30 while steadily exhibiting the function of the insertion guide originally given to the protection cover 10, the works for setting and replacing the process cartridge 30 of the user can be made ready.

According to the present embodiment, because the process cartridge 30 is configured to be able to replace the developing device 3 and the drum unit 33 in a body, readiness of maintenance is improved and the works for setting and replacing the process cartridge 30 of the image forming apparatus 60 can be performed readily. Because the protection cover 10 for protecting the photoconductive drum 1Bk is provided in a new process cartridge 30, there will be no such a case where the surface of the photoconductive drum 1Bk is unintentionally touched or damaged in handling the process cartridge 30. Because the protection cover 10 is utilized not only as the protection member but also as the guide member in attaching the process cartridge 30 to the body frame HF of the image forming apparatus 60, the works for setting and replacing the process cartridge 30 are improved.

According to the present embodiment, even if the protection cover 10 is a size of protecting the minimum necessary size of the opening 30*a*, the protection cover 10 is hardly removed unintentionally during the replacement work of the process cartridge 30. The present embodiment makes it possible to realize the engagement structure of the protection cover 10 that is hardly removed even if it is tried to be forcibly removed by an unanticipated operation by the simple configuration. Because the present embodiment also makes it possible to exhibit the original effect of using the protection cover 10 as the insertion guide of the process cartridge 30, the works for setting and replacing the process cartridge 30 of the user can be readily realized. It is also possible to prevent such problem that the photoconductive drum 1Bk is damaged by an erroneous operation of the user.

First Comparative Example

Figure 8:
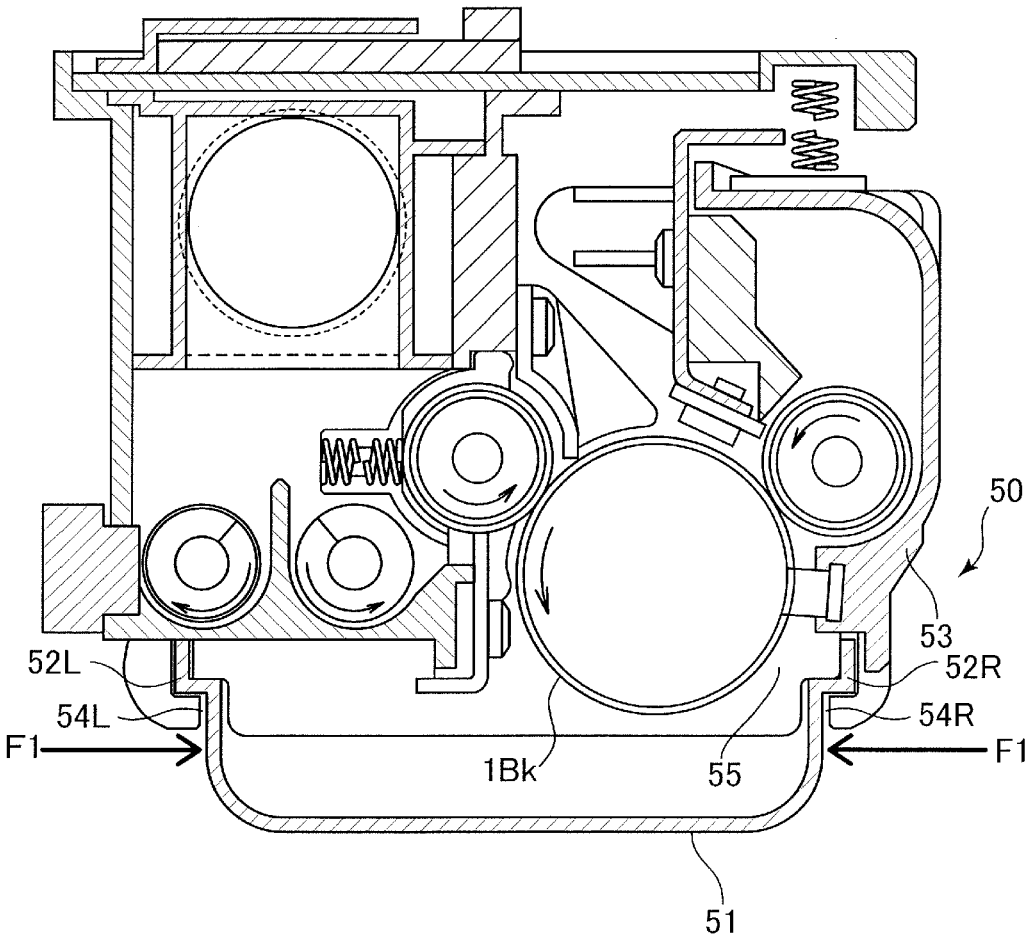
FIG. 8 is a section view schematically showing a configuration of a process cartridge of a first comparative example.

FIG. 8 illustrates a configuration of a process cartridge 50 of a first comparative example. As shown in FIG. 8, in the first comparative example, a protection cover 51 is attached to the process cartridge 50 so as to cover an opening 55 for exposing the photoconductive drum 1Bk to the outside. In the same manner with the first embodiment, the protection cover 51 is slidable in the longitudinal direction of the photoconductive drum container 53 (the inserting direction of the process cartridge 50) by engaging a casing of the process cartridge 50 with the protection cover 51 through engagement claws 52R and 52L.

Engagement grooves 54R and 54L formed into a shape of a crank are provided to the photoconductive drum container 53 across the opening 55. Each of the engagement grooves 54R and 54L is formed into the shape of the crank such that opening sides of the grooves approach with each other.

The protection cover 51 is provided with the engagement claws 52R and 52L in the shape of the crank corresponding to the engagement grooves 54R and 54L. The protection cover 51 slidable in the rotational axis direction of the photoconductive drum 1Bk (the inserting direction of the process cartridge 50) by engaging the engagement claw 52R with the engagement groove 54R and the engagement claw 52L with the engagement groove 54L.

Because the engagement grooves 54R and 54L formed into the shape of the crank hold the engagement claws 52R and 52L formed into the shape of the crank in the first comparative example, looseness between the protection cover 51 and the photoconductive drum container 53 is reduced. However, because the engagement claws 52R and 52L are configured such that they engage outwardly from each other, the protection cover 51 deflects convexly to the outside and the engagements with the engagement claws 52R and 52L are readily disengaged in a case where the user grasps and holds the protection cover 51 so as to add a force F1. For example, in a case where the user unpacks the process cartridge 50 and grasps and holds the protection cover 51 so as to add the force F1 as a load, the protection cover 51 deflects convexly to the outside and the engagement claws 52L and 52R are readily disengaged. If engagement claws 52L and 52R are disengaged, there is a possibility that the user misunderstand that the protection cover 51 is a member that should be removed before inserting the process cartridge 50 into the body frame HF of the image forming apparatus 60. The user also tends to misunderstand that a process of inserting the process cartridge 50 into the image forming apparatus 60 after removing the protection cover 51 is correct if the protection cover 51 can be readily removed.

There is also another problem that because a depth of the engagement of the engagement claws 52R and 52L and the engagement grooves 54R and 54L formed respectively into the shape of the crank is deepened, space utilization for storing parts of the process cartridge 50 is worsened.

With regard this problem, according to the image forming apparatus 60 of the first embodiment described above, the first and second convex portions 11R and 11L orient in the same direction, so that the protection cover 10 will not be readily removed because either one convex portion 11R or 11L bites into a direction in which the degree of engagement increases even if an external force F or a moment M acts on the protection cover 10. Still further, because the both of the first and second engage mechanisms 101 and 102 can engage by the engagement operation only in one side X1 in the X-axis direction, it is possible to make the depth of the engagement shallow and to improve the space utilization as compared to the case of engaging the engagement claws 52R and 52L form into the shape of the crank of the first comparative example.

Second Comparative Example

Figure 9A:
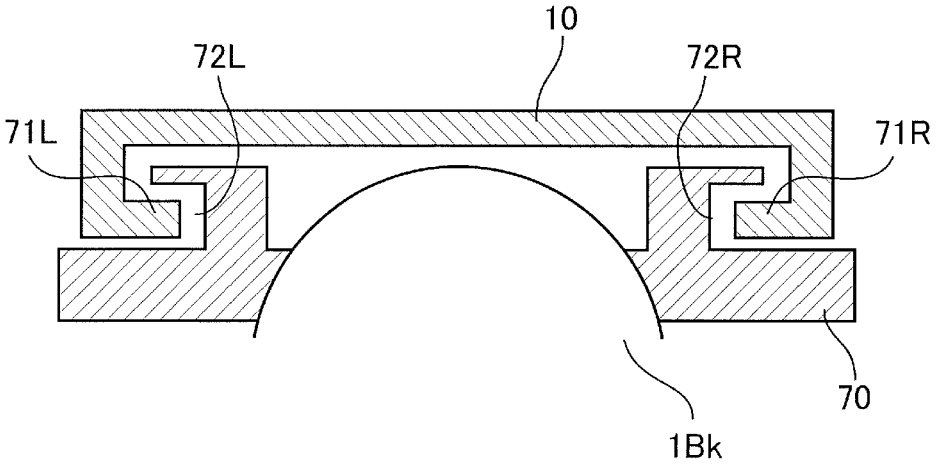
FIG. 9A illustrates a state in which no external force acts on a protection cover of a second comparative example attached to the process cartridge.
Figure 9B:
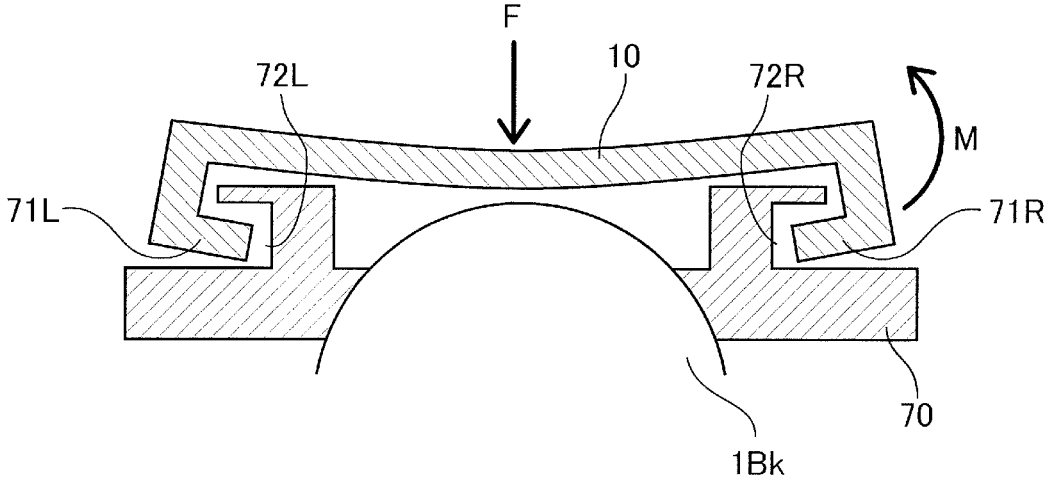
FIG. 9B illustrates a state in which an external force acts vertically in orientation to an opening to a protection cover of a second comparative example attached to the process cartridge.

FIGS. 9A and 9B illustrate an engagement structure of the protection cover 10 of a second comparative example. FIG. 9A illustrates a state in which the protection cover 10 is attached and FIG. 9B is illustrates a state in which the protection cover 10 is pressed downward. As shown in FIG. 9A, the protection cover 10 is additionally provided with the engagement claws 71R and 71L formed into a shape of a hook corresponding to engagement grooves 72R and 72L of a photoconductive drum container 70. Each of the engagement claws 71R and 71L is formed such that a front edge thereof faces the inside. The protection cover 10 is slidable in the rotational axis direction of the photoconductive drum 1Bk (the insertion direction of the process cartridge) by engaging the engagement claw 71R with the engagement groove 72R and the engagement claw 71L with the engagement groove 72L.

Because the engagement claws 71R and 71L formed in the shape of the hook which is simpler than the shape of the crank are used in the second comparative example, it is possible to attach the protection cover 10 which is less costly than the protection cover 51 of the first comparative example. Still further, the protection cover 10 of the second comparative example enables to assure a large degree of engagement in the horizontal direction, so that the protection cover 10 will be hardly removed from the photoconductive drum container 70 as compared to that of the first comparative example.

As shown in FIG. 9B, because the engagement claws 71R and 71L are formed in orientation to the inside with each other in the second comparative example, the protection cover 10 deflects and a distance between the engagement claws 71R and 71L is opened and the engagement claws 71R and 71L are disengaged if the user presses the protection cover 10 by a force F from above the protection cover 10.

With regard this problem, according to the image forming apparatus 60 of the first embodiment described above, the first and second convex portions 11R and 11L orient in the same direction, so that the protection cover 10 will not be readily removed because either one convex portion 11R or 11L bites into a direction in which the degree of engagement increases even if an external force F or a moment M acts on the protection cover 10.

Comparative Example

Figure 10A:
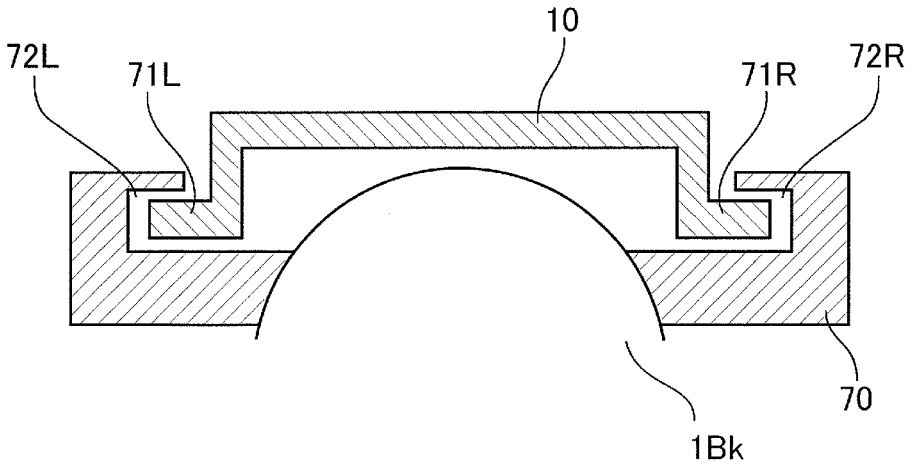
FIG.10A Prior art
FIG. 10A illustrates a state in which no external force acts on a protection cover of a third comparative example attached to the process cartridge.
Figure 10B:
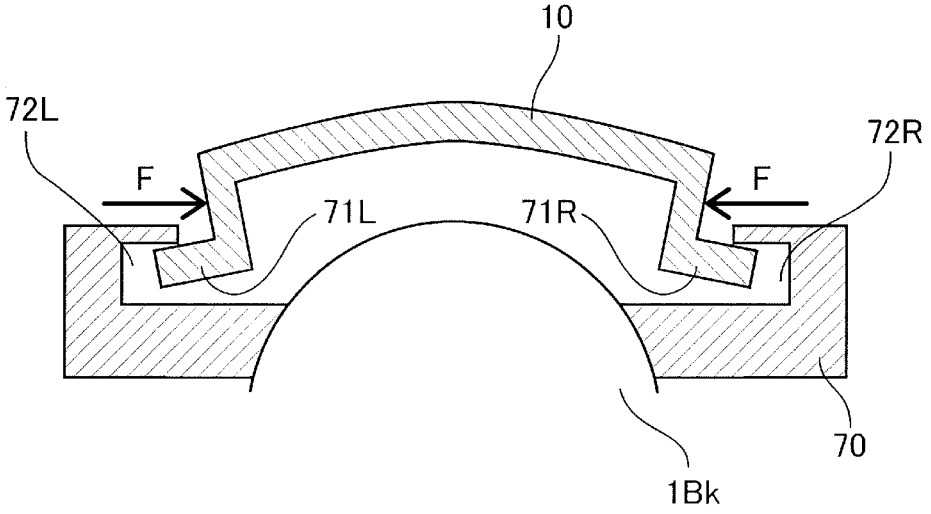
FIG.10B Prior art
FIG. 10B illustrates a state in which an external force acts by grasping the protection cover attached of the third comparative example to the process cartridge.

FIGS. 10A and 10B illustrate an engagement structure of the protection cover 10 of a third comparative example. FIG. 10A illustrates a state in which the protection cover 10 is attached, and FIG. 10B illustrates a state in which the protection cover 10 is grasped. As shown in FIG. 10A, the protection cover 10 is additionally provided with engagement claws 71R and 71L corresponding to engagement grooves 72R and 72L of the photoconductive drum container 70. The engagement claws 71R and 71L are formed such that their front ends face outside from each other.

As shown in FIG. 10B, because the engagement claws 71R and 71L are formed to face outside from each other in the third comparative example, the protection cover 10 deflects and a distance between the engagement claws 71R and 72L becomes narrow and are disengaged in a case where the user grasps the protection cover 10 from both sides thereof by a force F.

With regard this problem, according to the image forming apparatus 60 of the first embodiment described above, the first and second convex portions 11R and 11L orient in the same direction, so that the protection cover 10 will not be readily removed because either one convex portion 11R or 11L bites into a direction in which the degree of engagement increases even if the external force F or the moment M acts on the protection cover 10.

Fourth Comparative Example

As disclosed in Japanese Patent Application Laid-open No. 2009-75274, a cylindrical protection cover covering an outer periphery of the process cartridge is provided in a fourth comparative example. The protection cover is not be removed unintentionally even if a force acts from any direction in the fourth comparative example. However, it is costly and wasteful in terms of resources to use such cylindrical protection cover as the part which is used only in setting the process cartridge. There is another problem that because a packing size in shipping the product increases, a distribution cost increases.

With regard this problem, according to the image forming apparatus 60 of the first embodiment described above, the first and second convex portions 11R and 11L orient in the same direction, so that the protection cover 10 will not be readily removed because either one convex portion 11R or 11L bites into a direction in which the degree of engagement increases even if an external force F or a moment M acts on the protection cover 10. Still further, because the protection cover 10 covers only the opening 30*a*, it is possible to reduce the size as compared to the case of covering the entire process cartridge of the fourth comparative example. This arrangement makes it possible to reduce the packing size and to cut the distribution cost.

Second Embodiment

Figure 11A:
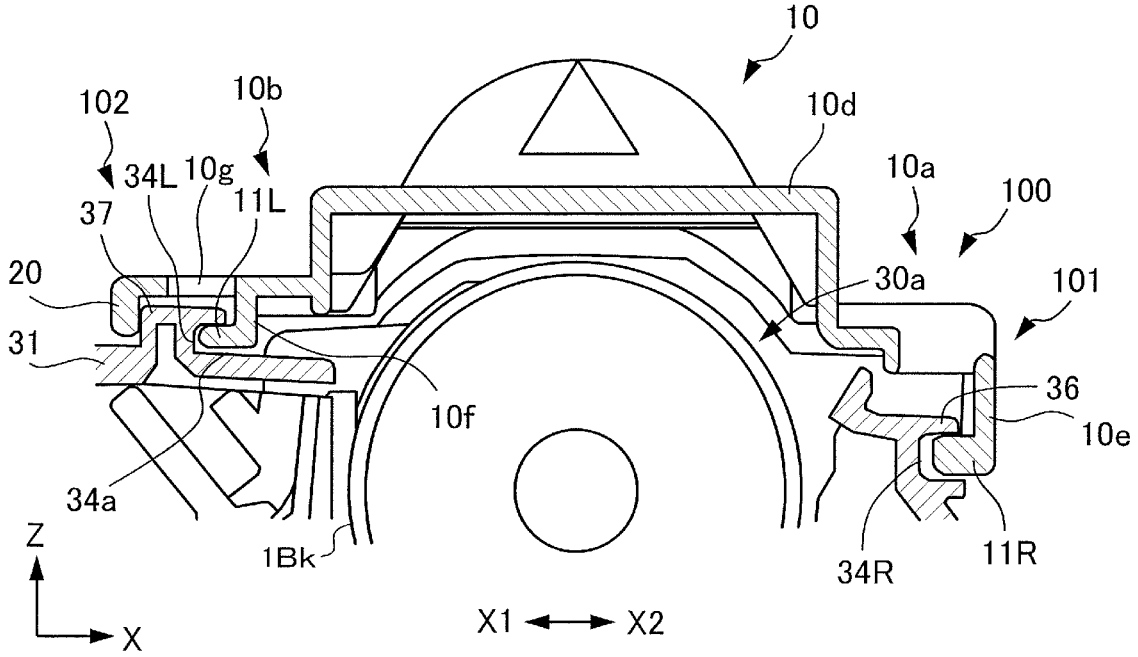
FIG. 11A illustrates a state in which a protection cover of a second embodiment is attached to the process cartridge.
Figure 11B:
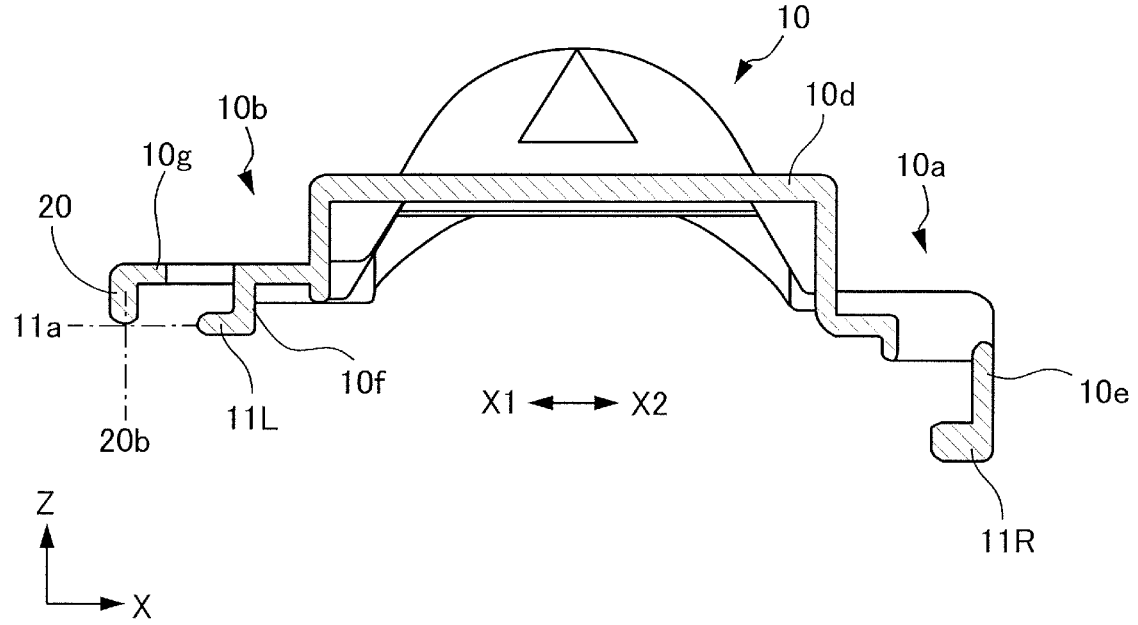
FIG. 11B is a section view schematically showing the protection cover of the second embodiment.

FIG. 11A illustrates a state in which a protection cover 10 of a second embodiment is attached to the process cartridge 30. FIG. 11B which no external force acts on the protection cover 10 attached to the photoconductive drum container 31 of the process cartridge 30 of the second embodiment. FIG. 12B illustrates a state in which an external force F' in the X-axis direction or a moment M acts on the protection cover 10 attached to the photoconductive drum container 31 of the second embodiment.

As shown in FIG. 6A, the structure (the restricting portion 80) blocking the respective engagements of the convex portions 11R and 11L with the concave portions 34R and 34L from becoming shallow is provided on the side of the process cartridge 30 in the first embodiment. In contrary, a protection portion (restricting portion) 20 is provided on the side of the protection cover 10 as a structure blocking the respective engagements of the convex portions 11R and 11L with the concave portions 34R and 34L from becoming shallow in the second embodiment. The configuration of the second embodiment is the same with the first embodiment other than that structure, so that the same reference numerals in FIGS. 1 through 7C will be assigned to the components of the second embodiment common with those of the first embodiment in FIGS. 11A through 12B and an overlapped explanation will be omitted here.

(Engagement Structure of the Present Embodiment)

As shown in FIG. 11A, the first and second concave portions 34R and 34L of the photoconductive drum container 31 and the first and second convex portions 11R and 11L of the protection cover 10 are the same with those of the first embodiment. The protection cover 10 is slidable in the Y-axis direction whole being restricted so as not to deviate in the Z-axis direction from the photoconductive drum container 31 in the same manner as shown in FIGS. 3A and 3B by engaging the second convex portion 11L with the second concave portion 34L in the same time of engaging the first convex portion 11R with the first concave portion 34R. The pluralities of respective convex portions 11R and 11L are disposed in the longitudinal direction of the process cartridge 30.

Figure 12A:
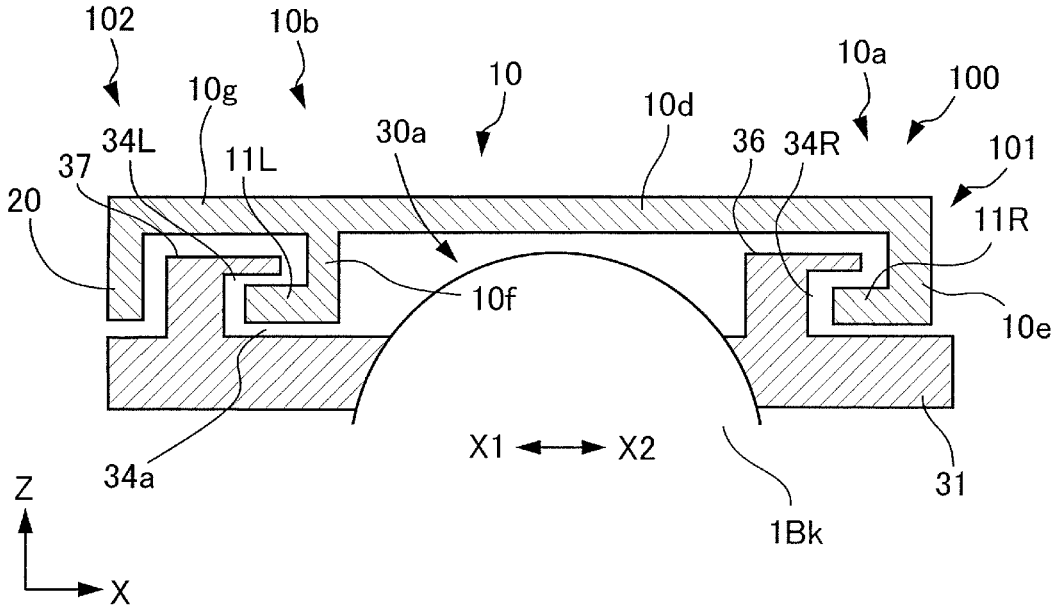
FIG. 12A illustrates a state in which no external force acts on a protection cover of the second embodiment attached to the process cartridge.
Figure 12B:
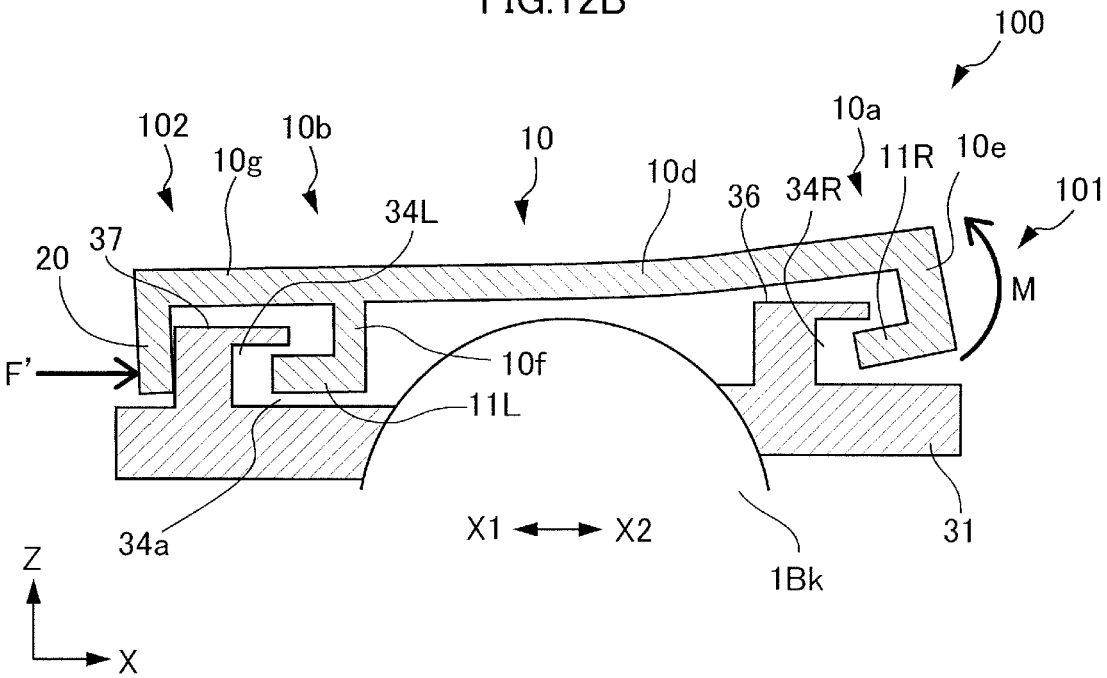
FIG. 12B illustrates a state in which an external force in an X-axis direction or an upward moment act to the protection cover of the second embodiment attached to the process cartridge.

As shown in FIG. 12A, the protection cover 10 includes a protection portion 20 covering a projection 37 forming the second concave portion 34L by turning around an outside in the X-axis direction of the second convex portion 11L. The protection cover 10 includes the protection portion 20 disposed adjacent the second convex portion 11L. Among a projection 36 forming the first concave portion 34R and a projection 37 forming the second concave portion 34L, the projection 37 which is not covered by the protection cover 10 is covered by the protection portion 20 in the present embodiment. The protection portion 20 is provided so as to cover the second convex portion 11L exposed out of the protection cover 10 among the first and second convex portions 11L and 11R. As shown in FIG. 11B, the protection portion 20 is a flange formed on an imaginary line 20*b* extended from a front end of the second convex portion 11L to an imaginary line 11*a* and protects the second convex portion 11L so as not to be exposed.

That is, the protection cover 10 includes a cover body 10*d*, the first convex portion 11R forming the first engage portion at a first end portion 10*a*, a first connecting portion 10*e* connecting the cover body 10*d* with the first convex portion 11R, the second convex portion 11L forming the second engage portion at a second end portion 10*b*, a second connecting portion 10*f* connecting the cover body 10*d* with the second convex portion 11L and supporting the second convex portion 11L such that the second convex portion 11L is positioned on the opening 34*a* side of the second concave portion 34L, the flange forming the protection portion 20 at the second end portion 10*b*, and a third connecting portion 10*g* connecting the cover body 10*d* with the flange.

The third connecting portion 10*g* extends in the X-axis direction so as to straddle the second concave portion 34L from the cover body 10*d* such that the flange is positioned on a side opposite from the opening 34*a* of the second concave portion 34L and covers the second concave portion 34L from an outside in a state in which the protection cover 10 is attached to the photoconductive drum container 31. This arrangement makes it possible to prevent the protection cover 10 from being removed by a foreign matter inserted into the second engage mechanism 102 because the second concave portion 34L is prevented from being exposed to the outside.

The protection portion 20 is provided in the protection cover 10 such that it is positioned in terms of the X-axis direction with respect the second concave portion 34L on the side opposite from the opening 34*a* of the second concave portion 34L, and restricts the protection cover 10 from moving to the other side X2 in the width direction by abutting against a surface on an opposite side from the opening 34*a* of the second concave portion 34L in the X-axis direction. This arrangement makes it possible to suppress the second convex portion 11L from abutting against the photoconductive drum 1Bk when the protection cover 10 deflects.

The first connecting portion 10*e* extends in the X-axis direction so as to straddle the first concave portion 34R from the cover body 10*d* and covers the first concave portion 34R from an outside in a state in which the protection cover 10 is attached to the photoconductive drum container 31. This arrangement makes it possible to prevent the protection cover 10 from being removed by a foreign matter inserted into the first engage mechanism 101 because the first concave portion 34R is prevented from being exposed to the outside.

Effect of the Present Embodiment

As shown in FIG. 12A, the protection portion 20 is formed integrally with the protection cover 10. The protection portion 20 abuts from the X-axis direction against a surface on a side opposite from a direction in which the engagement becomes shallow in the projection 37 where the second concave portion 34L is formed and restricts moves of the protection cover 10.

As shown in FIG. 12B, because the protection portion 20 abutting against the projection 37 receives an external force F' in the X-axis direction in the present embodiment, the external force F' acting on the protection cover 10 will not directly act on the second convex portion 11L and the protection cover 10 hardly deflects. For instance, the external force F' acts on the protection cover 10 when the user holds the process cartridge 30 by grasping the protection cover 10 by the both ends in the X-axis direction. Such a scene is readily imaginable.

As shown in FIG. 12B, a deflection of the first convex portion 11R is backed up by the projection 36 of the first concave portion 34R and a deflection of the second convex portion 11L is backed up by the projection 37 of the second concave portion 34L in the present embodiment. Accordingly, this arrangement makes it possible to reduce a possibility of the protection cover 10 from being removed in a case where the external force F' acts on the protection cover 10 and to steadily exhibit the function as the insertion guide originally given to the protection cover 10.

According to the present embodiment, it is possible to reduce the possibility of the protection cover 10 from being removed even in a case where the external force F' acts on the protection portion 20 from the X-axis direction. Because the flange-like protection portion 20 and the third connecting portion 10*g* enhance flexural rigidity of the second end portion 10*b* of the protection cover 10, the protection portion 20 also receives a moment M of disengaging the first convex portion 11R from the first concave portion 34R and the moment M does not act only to the second convex portion 11L and the protection cover 10 is hardly removed. Because the protection portion 20 restricts the projection 37, the protection cover 10 is hardly shifted in the X-axis direction even if the engagement of the convex portions 11R and 11L becomes shallow.

According to the present embodiment, because the protection portion 20 is provided on the protection cover 10 side, a degree of freedom is large in terms of parts design and parts processing more than the case of the first embodiment in which the restricting portion 80 is provided on the process cartridge 30 side. The protection cover 10 has a relatively simple shape as compared to the photoconductive drum container 31 and is a component not requiring much precision. Accordingly, there is less restriction in terms of the parts design and parts processing and the degree of freedom is high to provide the protection portion 20 to the protection cover 10.

OTHER EMBODIMENTS

The image forming apparatus 60 of the first and second embodiments described above can be carried out by another embodiment in which a part or the whole of the configuration of the embodiments are replaced with their substitutive configuration as long as the engagement direction of the first and second engage mechanisms 101 and 102 are the same.

Accordingly, the image forming apparatus 60 can be carried out regardless of one drum type, or a tandem type or an intermediate transfer type or a recording medium conveying type. It is also possible to carry out regardless a number of photoconductive drums, a charging method, an electrostatic image forming method, a transfer method, a fixing method, and others. While only a main part related to formation and transfer of toner images has been explained here, the present invention can be carried out in image forming apparatuses of various uses such as a printer, various printing machines, a copier, a facsimile, and a multi-function machine by adding necessary devices, equipment, and a casing structure.

The image forming apparatus 60 may be also carried out not only in the system in which the photoconductive drums 1Y, 1M, 1C, and 1Bk are exposed from below as shown in FIG. 1 (the system in which the protection cover 10 covers an upper surface of the process cartridge 30), but also in a system in which the photoconductive drums 1Y, 1M, 1C, and 1Bk are exposed from above (a system in which the protection cover 10 covers a lower surface of the process cartridge 30).

It is also possible to carry out the invention not only in the case of orienting the both of the convex portions (engagement claws) 11R and 11L of the protection cover 10 in one direction X1 (orient in the left side) in the X-axis direction seen from the direction inserting the process cartridge 30 but also in a case of orienting the both of them in the other side X2 (orient in the right side) in the X-axis direction.

The present invention may be also carried out not only in the case in which the process cartridge 30 contains the drum cleaning device 5, but also in a case in which the drum cleaning device 5 is provided as an independent replacement unit. The present invention may be carried out also in a case in which the drum cleaning device 5 and the charging device 2 are set as an independent replacement unit and the photoconductive drums 1Y, 1M, 1C and 1Bk and the developing device 3 are gathered as one process cartridge 30.

Still further, while the both of the restricting portion 80 and the protection portion 20 are provided on the second engage mechanism 102 side in the embodiments described above, the present invention is not limited to that case and the restricting portion 80 and the protection portion 20 may be provided on the first engage mechanism 101 side.

Still further, while the first engage portion formed on the protection cover 10 is provided as the first convex portion 11R, the second engage portion as the second convex portion 11L, the first engaged portion formed on the photoconductive drum container 31 as the first concave portion 34R and the second engaged portion as the second concave portion 34L in the embodiments described above, the present invention is not limited to such a case.

Still further, while the first convex portion 11R includes the plurality of first engage members 11R1 through 11R4 and the second convex portion 11L includes the plurality of second engage members 11L through 11L4 in the embodiments described above, the present invention is not limited to such a case. For instance, it is also possible to configure such that a number of the engage members of at least one of the first and second convex portion 11R and 11L is singular.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No 2013-182006, filed Sep. 3, 2013 which is hereby incorporated by reference herein in its entirety.

What is claimed is:

1. An image carrier unit comprising:

an image carrier;

a unit casing configuring and positioned to rotatably support the image carrier;

a protection cover, detachably mountable to the unit casing slidably in a rotational axis direction of the image carrier, configured to cover a part of the image carrier;

an engage mechanism configured to engage the protection cover to the unit casing;

the engage mechanism including:

a first projecting portion, provided on a first end portion of the protection cover in a width direction perpendicular to the rotational axis direction of the image carrier, configured to project from the first end portion into one width direction;

a first engaged portion, provided in the unit casing, configured to engage with the first projecting portion;

a second projecting portion, provided on a second end portion of the protection cover in the width direction, configured to project from the second end portion into the one width direction;

a second engaged portion, provided in the unit casing on a side opposite from the first engaged portion across image carrier in the width direction, configured to engage with the second projecting portion.

2. The image carrier unit according to claim 1, wherein the first projecting portion is configured to be formed into a shape convex in orientation to the one width direction, wherein the first engaged portion is configured to be formed into a concave shape opening in orientation to another width direction, wherein the second projecting portion is configured to be formed into a shape convex in orientation to the one width direction, and wherein the second engaged portion is configured to be formed into a concave shape opening in orientation to the another direction.

3. The image carrier unit according to claim 1, further comprising a restricting portion provided at either one of the unit casing or the protection cover and restricting the protection cover attached to the unit casing from moving into another width direction by abutting against the other one of the unit casing and the protection cover.

4. The image carrier unit according to claim 2, further comprising a restricting portion provided at either one of the unit casing or the protection cover and restricting the protection cover attached to the unit casing from moving into the another width direction by abutting against the other one of the unit casing and the protection cover.

5. The image carrier unit according to claim 4, wherein the restricting portion is provided to the unit casing so as to face, in the width direction, to an opening of the second engaged portion formed into the concave shape when seen from the rotational axis direction and restricts the second projecting portion engaged with the second engaged portion disposed between the second engaged portion and the restricting portion from moving in the width direction.

6. The image carrier unit according to claim 5, wherein the second engaged portion is formed so as to open in the width direction in orientation to the image carrier side, and wherein the restricting portion is disposed between the second engaged portion and the image carrier in terms of the width direction.

7. The image carrier unit according to claim 4, wherein the restricting portion is provided to the protection cover such that the widthwise position thereof is positioned, with respect to the second engaged portion, on a side opposite from an opening of the second engaged portion and restricts the protection cover from moving into the another width direction by abutting against a surface on the opposite side of the opening of the second engaged portion.

8. The image carrier unit according to claim 7, wherein the protection cover includes:

a cover body;

a first convex portion forming the first projecting portion at the first end portion;

a first connecting portion connecting the cover body with the first convex portion;

a second convex portion forming the second projecting portion at the second end portion;

a second connecting portion connecting the cover body with the second convex portion and supporting the second convex portion such that the second convex portion is positioned on a side of an opening of the second engaged portion;

a flange portion forming the restricting portion at the second end portion; and a third connecting portion connecting the cover body with the flange portion, the third connecting portion extending in the width direction from the cover body so as to straddle the second engaged portion such that the flange portion is positioned on a side opposite from the opening of the second engaged portion and covering the second engaged portion from an outside in a state in which the protection cover is attached to the unit casing.

9. The image carrier unit according to claim 8, wherein the first connecting portion extends in the width direction from the cover body so as to straddle the first engaged portion and covers the first engaged portion from the outside in a state in which the protection cover is attached to the unit casing.

10. The image carrier unit according to claim 1, wherein the first projecting portion includes a plurality of first engage members disposed at a plurality of places with intervals along the rotational axis direction, and wherein the second projecting portion includes a plurality of second engage members disposed at a plurality of places facing the first engage members along the rotational axis direction.

11. The image carrier unit according to claim 1, wherein the protection cover includes an abutment portion abutting against a casing of the image forming apparatus in attaching the unit casing to the casing of the image forming apparatus by moving the unit casing in the rotational axis direction and removing the protection cover out of the unit casing by moving the protection cover in the rotational axis direction with respect to the unit casing.

12. An image forming apparatus comprising:

an image carrier unit including:

an image carrier; and a unit casing configured and positioned to rotatably support the image carrier, the unit casing including:

a first engaged portion configured such that a first projecting portion provided on a first end portion of the width direction of a protection cover engages in orientation to one width direction perpendicular to the rotational axis direction of the image carrier; and a second engaged portion configured such that a second projecting portion provided on a second end portion of the width direction of the protection cover so as to face the first end portion in the width direction engages in orientation to the one width direction;

an intermediate transfer body disposed to come into contact with the image carrier; and a casing of the image forming apparatus capable of attaching the image carrier unit.

13. The image forming apparatus according to claim 12, wherein the casing of the image forming apparatus includes an abutted portion abutting against an abutment portion of the protection cover in attaching the image carrier unit to the casing of the image forming apparatus by moving in the rotational axis direction and removing the protection cover out of the unit casing.

14. The image forming apparatus according to claim 13, wherein the casing of the image forming apparatus includes a holding portion holding the protection cover removed out of the unit casing in attaching the image carrier unit to the casing of the image forming apparatus.

15. The image forming apparatus according to claim 14, wherein the holding portion is a fitting portion holding the protection cover by fitting with the abutment portion.

* * * * *